US010352132B2

(12) United States Patent
Griffith

(10) Patent No.: US 10,352,132 B2
(45) Date of Patent: Jul. 16, 2019

(54) AUTOMATIC DOWNHOLE JETTING SYSTEM

(71) Applicant: David Griffith, Rocky View County (CA)

(72) Inventor: David Griffith, Rocky View County (CA)

( * ) Notice: Subject to any disclaimer, the term of this patent is extended or adjusted under 35 U.S.C. 154(b) by 287 days.

(21) Appl. No.: 15/296,526

(22) Filed: Oct. 18, 2016

(65) Prior Publication Data

US 2018/0106132 A1 Apr. 19, 2018

(51) Int. Cl.

| | |
|---|---|
| ***E21B 43/114*** | (2006.01) |
| ***E21B 34/14*** | (2006.01) |
| ***E21B 37/00*** | (2006.01) |
| ***E21B 21/10*** | (2006.01) |
| ***E21B 31/03*** | (2006.01) |

(52) U.S. Cl.

CPC ..... *E21B 37/00* (2013.01); *E21B 21/103* (2013.01); *E21B 31/03* (2013.01); *E21B 34/14* (2013.01)

(58) Field of Classification Search

CPC ..... E21B 37/00; E21B 34/14; E21B 43/114
See application file for complete search history.

(56) References Cited

U.S. PATENT DOCUMENTS

| | | | | |
|---|---|---|---|---|
| 1,875,414 | A | 9/1930 | Burt | |
| 2,765,146 | A | 10/1956 | Williams, Jr. | |
| 3,371,729 | A | 5/1968 | Carr | |
| 6,109,370 | A | 8/2000 | Gray | |
| 6,263,984 | B1 | 7/2001 | Buckman, Sr. | |
| 6,338,390 | B1 | 1/2002 | Tibbitts | |
| 6,530,439 | B2 | 3/2003 | Mazorow | |
| 8,186,459 | B1 | 5/2012 | Mazorow | |
| 8,607,896 | B2 | 12/2013 | Kolle et al. | |
| 9,435,172 | B2 | 9/2016 | Oettli et al. | |
| 2013/0000888 | A1* | 1/2013 | Geldard | E21B 34/14 166/222 |
| 2015/0114644 | A1* | 4/2015 | Oettli | E21B 21/103 166/301 |

FOREIGN PATENT DOCUMENTS

| | | | |
|---|---|---|---|
| CA | 2671171 | A1 | 1/2011 |

* cited by examiner

*Primary Examiner* — Catherine Loikith
(74) *Attorney, Agent, or Firm* — David A. Guerra

(57) ABSTRACT

An automatic downhole jetting system for advancing a string and automatically operating a valve mechanism upon contact with a restriction in a wellbore. A jetting unit receives a working fluid, and an activation unit slidably engaged with the jetting unit. The jetting unit includes the valve mechanism for controlling fluid flow out through angled jet ports or through the activation unit. The activation unit can move toward the jetting unit upon contact with a restriction in the wellbore. The activation unit activates the valve mechanism, thereby allowing fluid to flow past the activation unit to remove the restriction. Upon removal of the restriction, the fluid flow deactivates the valve mechanism, thereby closing fluid flow past the activation unit and continuing jetting operation.

20 Claims, 4 Drawing Sheets

AUTOMATIC DOWNHOLE JETTING SYSTEM

BACKGROUND OF THE INVENTION

Field of the Invention

The present invention relates to an automatic downhole jetting system for use in connection with advancing a downhole string or tool, cleaning out a wellbore, and automatically operating a valve mechanism upon contact with a restriction in the wellbore.

Description of the Prior Art

The use of a positive displacement motor (PDM) in association with coiled tubing may be utilized with a milling tool for operation in drilling subterranean wellbores. Subsequent to drilling, a cleaning apparatus may then be lowered into the well to remove downhole debris such as bridge plugs, frac seats, sand, proppant, scale, etc., which may also be referred to as "fill." Such cleanout operations can be difficult, time consuming and costly when such operations are involved in lengthy and/or horizontal wells. In such scenarios, the PDM may be utilized at the end of a bottom-hole-assembly (BHA) to, for example, reduce debris, obstructions, and other obstacles to a particle size sufficient to ensure they become entrained in drilling fluid to be brought to the surface. However, with horizontal or offset wellbores, the fill may settle in front of the PDM and/or a restriction may by present in the wellbore thereby creating a blockage that obstructs the advancement of the tool.

While some BHA's fulfill their respective, particular objectives and requirements, the aforementioned patents do not describe an automatic downhole jetting system that allows advancement of a downhole tool while providing cleaning operations and automatically operating a valve mechanism upon contact with a restriction in the wellbore.

Therefore, a need exists for a new and improved automatic downhole jetting system that can be used for advancing a downhole tool and automatically operating a valve mechanism. In this regard, the present invention substantially fulfills this need. In this respect, the automatic downhole jetting system according to the present invention substantially departs from the conventional concepts and designs of the prior art, and in doing so provide an apparatus primarily developed for the purpose of advancing a downhole tool and automatically operating a valve mechanism.

SUMMARY OF THE INVENTION

In view of the foregoing disadvantages inherent in the known types of jetting downhole tools now present in the prior art, the present invention provides an improved automatic downhole jetting system, and overcomes the above-mentioned disadvantages and drawbacks of the prior art. As such, the general purpose of the present invention, which will be described subsequently in greater detail, is to provide a new and improved automatic downhole jetting system and method which has all the advantages of the prior art mentioned heretofore and many novel features that result in an automatic downhole jetting system which is not anticipated, rendered obvious, suggested, or even implied by the prior art, either alone or in any combination thereof.

The present invention broadly is an automatic downhole jetting system for advancing a string or BHA, cleaning out a wellbore and automatically operating a valve mechanism upon contact with a restriction in the wellbore. The system includes a jetting unit coupled downstream to a downhole string or PDM, and an activation unit slidably engaged with the jetting unit. The jetting unit includes the valve mechanism for controlling fluid flow out through angled jet ports or through the activation unit. The activation unit can move toward the jetting unit upon contact with a restriction in the wellbore. The activation unit activates the valve mechanism, thereby allowing fluid to flow past the activation unit for operation associated with removal of the restriction. Upon removal of the restriction, and consequently the force acting on the activation, the fluid flow deactivates the valve mechanism, thereby closing fluid flow to past the activation unit and continuing jetting operation.

To attain this, the present invention essentially comprises an automatic downhole jetting system including a jetting unit, and an activation unit. The jetting unit can include a jetting unit body defining a hollow interior therethrough, at least one jet port defined through the body and in fluid communication with the hollow interior, at least one valve mechanism located in the hollow interior. The hollow interior is capable of receiving a working fluid from a string or a downhole tool, such as a PDM. The valve mechanism has a configuration capable of preventing the working fluid to pass therethrough when the valve mechanism in not activated. It can be appreciated that the jetting unit body may be a tubular configuration.

The activation unit is slidably associated with a section of the jetting unit. The activation unit can include an activation unit body defining a hollow interior therethrough, a first end, and a second end. The first end has a configuration capable of activating the valve mechanism upon a sliding movement of the activation unit toward the jetting unit. The hollow interior of the activation unit body can be in fluid communication with the hollow interior of the jetting unit body upon activation of the valve mechanism. It can be appreciated that the activation unit body may be a tubular configuration.

There has thus been outlined, rather broadly, the additional features of the invention in order that the detailed description thereof that follows may be better understood and in order that the present contribution to the art may be better appreciated.

The invention may also include a receiver unit attachable to a second end of the jetting unit. The receiver unit can include a receiver unit body defining a hollow interior therethrough, a first end attachable to the jetting unit, and a second end. A portion of the hollow interior of the receiver unit body has a configuration capable of slidably receiving a portion of the activation unit. It can be appreciated that the receiver unit body may be a tubular configuration. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved automatic downhole jetting system that has all of the advantages of the prior art jetting downhole tools and none of the disadvantages.

It is another object of the present invention to provide a new and improved automatic downhole jetting system that may be easily and efficiently manufactured and marketed.

An even further object of the present invention is to provide a new and improved automatic downhole jetting system that has a low cost of manufacture with regard to both materials and labor, and which accordingly is then susceptible of low prices of sale to the consuming public, thereby making such automatic downhole jetting system economically available to the buying public.

Still another object of the present invention is to provide a new automatic downhole jetting system that provides in the apparatuses and methods of the prior art some of the advantages thereof, while simultaneously overcoming some of the disadvantages normally associated therewith.

Even still another object of the present invention is to provide an automatic downhole jetting system for advancing a downhole tool, cleaning out a wellbore and automatically operating a valve mechanism upon contact with a restriction in the wellbore. This allows for the advancement of the string or BHA using jetted flow as thrust, in combination with using the jetted flow in a clean out operation, and further in combination with automatic valve operations actuated upon contact with a restriction in the wellbore.

Lastly, it is an object of the present invention to provide a new and improved method of using an automatic downhole jetting system, including the steps of receiving a working fluid to a jetting unit.

Closing a valve mechanism in the jetting unit by a flow of the working fluid. The valve mechanism has a configuration capable of preventing the working fluid to flow past the valve mechanism when the valve mechanism is not activated or in a closed position.

With the valve mechanism not activated, the working fluid will flow through at least one jet port defined in the jetting unit. The fluid exiting the jet port can be utilized to advance the BHA forward and/or to clean out the wellbore.

When the string or BHA in association with the present invention contacts a restriction in the wellbore, an activation unit will move toward the jetting unit. A first end of the activation unit will activate the valve mechanism upon a sliding movement of the activation unit toward the jetting unit.

The activation of the valve mechanism will open a passage between a hollow interior defined through the jetting unit and a hollow interior defined through the activation unit so that at least a portion of the working fluid passes into the hollow interior of the activation unit.

The working fluid passing through the activation unit can enter a drilling unit and operates the drilling unit to remove the restriction in the wellbore.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings, with any phantom lines depicting environmental structure, wherein.

The same reference numerals refer to the same parts throughout the various figures.

DETAILED DESCRIPTION OF THE INVENTION

Figure 1:
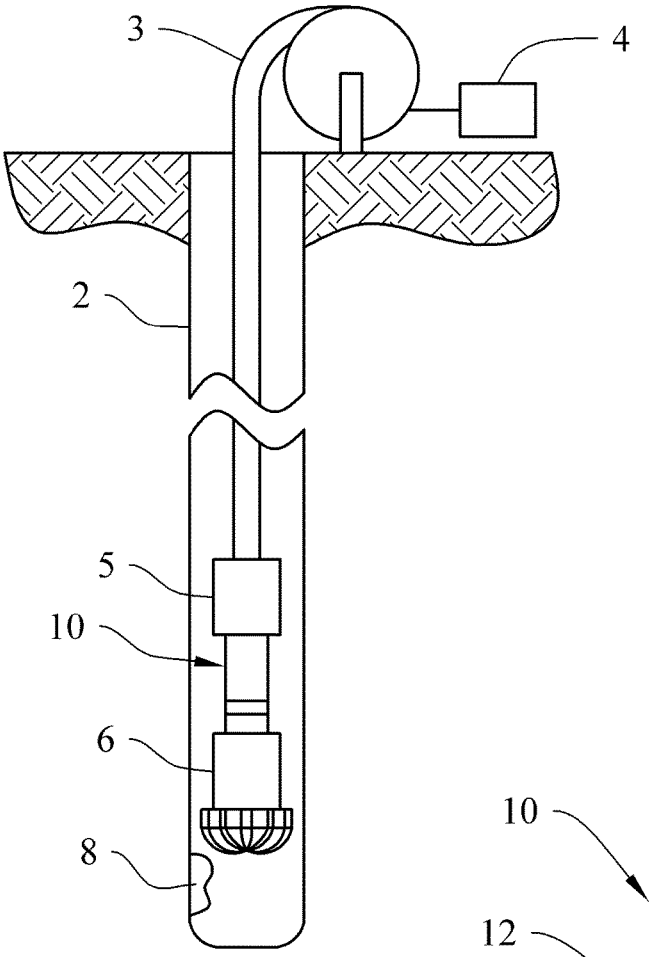
FIG. 1 is a schematic view of an embodiment of the automatic downhole jetting system constructed in accordance with the principles of the present invention.

Referring now to the drawings, and particularly to FIGS. 1-6, an embodiment of the automatic downhole jetting system of the present invention is shown and generally designated by the reference numeral 10.

In FIG. 1, a new and improved automatic downhole jetting system 10 of the present invention for advancing a downhole tool, cleaning out a wellbore and automatically operating a valve mechanism is illustrated and will be described. The automatic downhole jetting system 10 can be utilized in a subterranean wellbore 2 in association with a downhole string that can be, but not limited to, a coiled tubing 3. A source of working fluid 4 can be included which provides working fluid to a downhole tool, such as but not limited to, a positive displacement motor (PDM) 5. The PDM 5 can supply mechanical or hydraulic power to a drilling or milling unit 6, thereby creating a bottom-hole assembly (BHA) that can include the PDM 5, the drilling unit 6 and other downhole tools, in combination with the automatic downhole jetting system 10. It can be appreciated that the automatic downhole jetting system 10 can be attached directly to the coiled tubing 3 as a stand-alone unit or BHA receiving working fluid directly from the working fluid source 4, normally located at the surface. It can be further appreciated that the working fluid can be supplied by a pump associated with the coiled tubing 3.

In some situations, the wellbore 2 can form or include a restriction or obstruction 8 that creates a blockage in the wellbore 2 that prohibits advancement of the BHA. The automatic downhole jetting system 10 of the present invention overcomes these situations by providing a universal downhole tool that advances the BHA using jetted thrust, at the same time can be reversed in direction to create a clean out operation, and which can automatically provide working fluid to flow to and operate the drilling unit 6 upon contact with the restriction 8. This automatic operation allows for the removal of the restriction 8 for continued advancement of the BHA without removing the BHA from the wellbore 2 for replacement of downhole tools.

At least a portion of the wellbore 2 may be cased, although one or more aspects of the present disclosure may be similarly applicable and/or readily adaptable for use with uncased or "open" wellbores. Thus, it can be appreciated that the wellbore 2 can be a vertical, horizontal, and/or deviated wellbore.

The drilling unit 6 can be any downhole fluid operating drill or milling bit, with the supply of the working fluid being provided by the working fluid source 4 and/or the PDM 5. It can be appreciated that the drilling unit 6 can be but not limited to, a rotary bit or a fluid jet bit.

Figure 2:
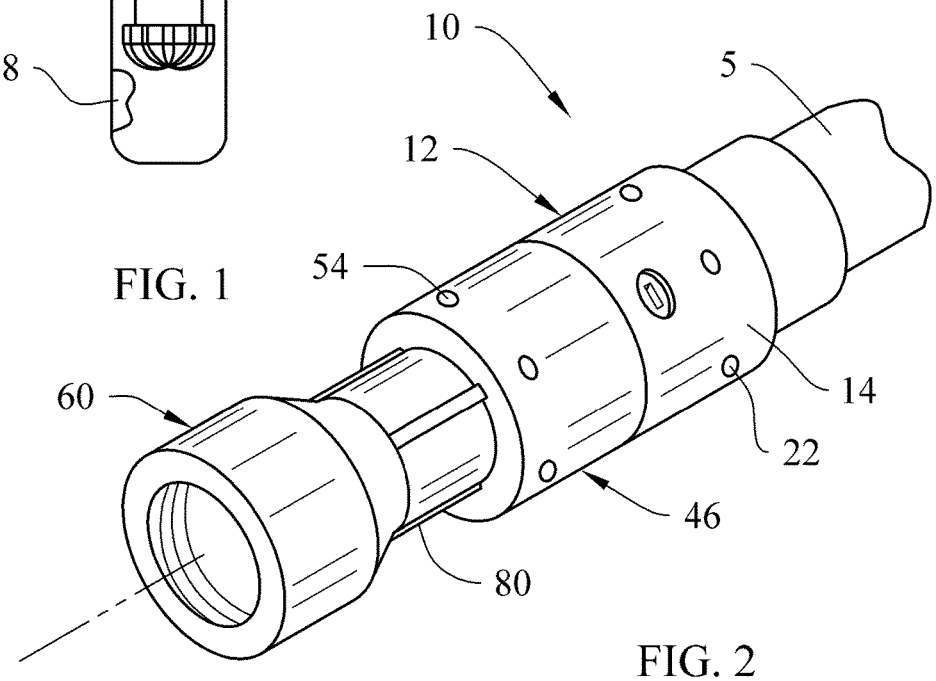
FIG. 2 is a perspective view of the jetting assembly of the present invention.

More particularly and with reference with FIG. 2, the automatic downhole jetting system 10 includes a jetting unit 12, a receiver unit 46 fittable to the jetting unit 12, and an activation unit 60 movably coupled with the receiver unit 46. The jetting unit 12 can be connected to the PDM 5, the coiled tubing 3 or other downhole tools, with the jetting unit 12 being located below or downstream of the PDM 5. The drilling unit 6 can be connected to the activation unit 60, thereby locating the automatic downhole jetting system 10 between the PDM 5 and the drilling unit 6. It can be appreciated that the PDM 5 and/or the drilling unit 6 can be carried by and/or forming part of the automatic downhole jetting system 10, thereby creating a single and integral downhole tool or sub. It can further be appreciated that the automatic downhole jetting system 10 can be carried by and/or forming part of additional downhole tools or subs, so as to provide the automatic downhole jetting system 10 as universally attachable tool operating as a jetting and automatic valve sub.

In the above configuration, the automatic downhole jetting system 10 receives working fluid from the working fluid source 4 or the PDM 5, and controls the working fluid upstream of the drilling unit 6.

Figure 3:
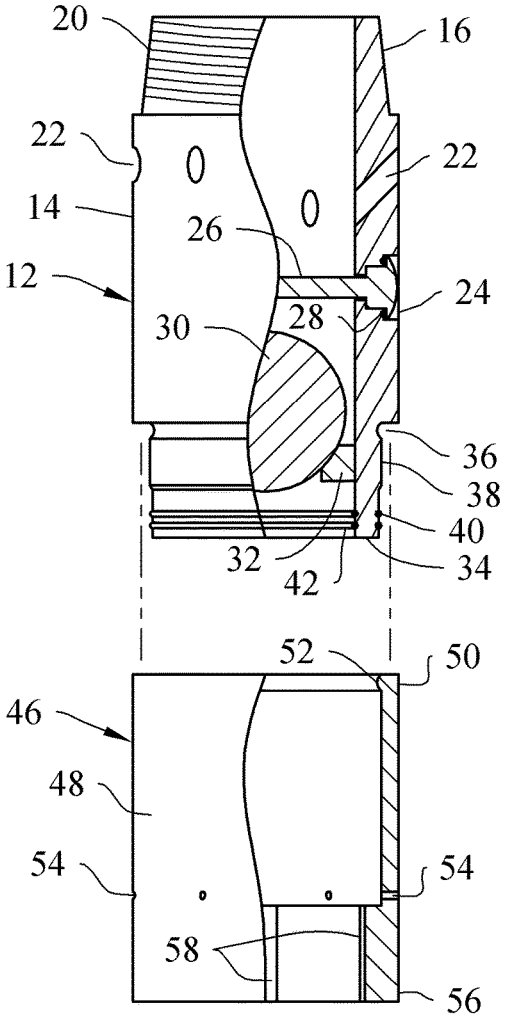
FIG. 3 is a partial cross-sectional view of the jetting unit and the receiver unit of the present invention.

As best illustrated in FIG. 3, the jetting unit 12 and the receiver unit 46 are fittingly coupled together. It can be appreciated that the jetting unit 12 and the receiver unit 46 can be removably coupled to allow for different receiver units to be attached to the jetting unit 12. The jetting unit 12 includes a jetting unit body 14 featuring a hollow interior therethrough, a first end 16 with internal or external threading 20, and a second end 34. The threading 20 engagingly couples with corresponding threading of the coiled tubing 3 or PDM 5. Defined through the jetting unit body 14 are radially located jet ports 22. The jet ports 22 are angled outwardly at an angle $\alpha$ toward the first end 16 thereby creating a rearwardly directing fluid jet flow. It can be appreciated that the jetting unit body 14 may be formed as a tubular with a diameter capable of being received through the wellbore 2.

A pin bore 24 is defined through the jetting unit body 14, and has a configuration capable of receiving a retaining pin 26 therethrough. The retaining pin 26 can include an engaging portion, such as but not limited to threading, that engages with a corresponding engaging portion of the pin bore 24, thereby securing the retaining pin 26 with the pin bore 24. The retaining pin 26 further includes a shank portion that extends into the hollow interior of the jetting unit body 14. The pin bore 24 can include concentric ledges that correspond with ledges of the retaining pin 26. A pin seal 28 can be associated between adjacent ledges of the pin bore 24 and retaining pin 26. The pin seal 28 prevents working fluid from escaping the jetting unit body 14 or prevents fluid from entering the jetting unit body 14 from the wellbore annulus.

The jetting unit 12 can further include a valve mechanism featuring a movable valve member, such as but not limited to, a ball, a plug, a flapper, a diaphragm, a piston or the like. It can be appreciated that the valve member can include mechanical or electrical activation means for operating the valve member, including but not limited to, sensors, motors, linear drives, biasing elements, springs, rotating bodies, gears or the like.

For exemplary purpose, the valve member of the present invention references a movable member being that of a ball 30 and a ball seat 32 located within the hollow interior of the jetting unit body 14. The ball 30 can have a size that allows working fluid to pass therearound. The ball seat 32 can include an opening therethrough, and an interior surface that corresponds with an exterior surface of the ball 30. The interior surface provides a smooth contacting surface between the exterior surface of the ball 30 and the ball seat 32, thus preventing any working fluid to pass through the opening of the ball seat 32 when the ball 30 is seated against the interior surface of the ball seat 32. The ball 30 can be located between the retaining pin 26 and the ball seat 32, wherein the retaining pin 26 is located upstream of the ball 30 at a distance sufficient to allow the ball 30 to move away from the ball seat 32 and thus opening a fluid communication between the hollow interior of the jetting unit body 14 and the opening of the ball seat 32.

It can be appreciated that the retaining pin 26 can be any retention means that extends into the hollow interior of the jetting unit body 14 that prevents the ball 30 from traveling out the first end 16. It can be further appreciated that the ball 30 can be a deformable element that can travel through the coiled tubing 3, optionally from the surface, to the ball seat 32. With the deformable element passing through the retention means by deforming. Even still further, the ball 30 can be a dissolvable element.

The second end 34 can include a section having a diameter less than a diameter of the jetting unit body 14, thus creating a flanged edge. An annular notch 36 is defined adjacent this flanged edge, and a smooth annular surface 38 extends adjacently from the annular notch 36. The second end 34 can further include at least one exterior seal 40 and at least one interior seal 42.

The receiver unit 46 can include a receiver body 48 with a hollow interior defined therethrough, a first end 50 and a second end 56. The first end 50 can include an interiorly extending annular lip 52 featuring a shape that corresponds with the annular notch 36. The annular lip 52 and the annular notch 36 have a configuration capable of engaging with each other when assembled, while providing rotational movement between each other and preventing longitudinal separation. The receiver body 48 features a smooth interior surface section that can sealingly contact with the exterior seal 40 when assembled. The receiver body 48 can further include radially defined receiver ports 54. It can be appreciated that the receiver body 48 may be a tubular.

The second end 56 of the receiver unit 46 can include an interior surface defining at least one key notch 58. The key notch 58 can extend a longitudinal distance of a length of the receiver body 48, and can be parallel with a longitudinal axis of the receiver body 48.

Figure 4:
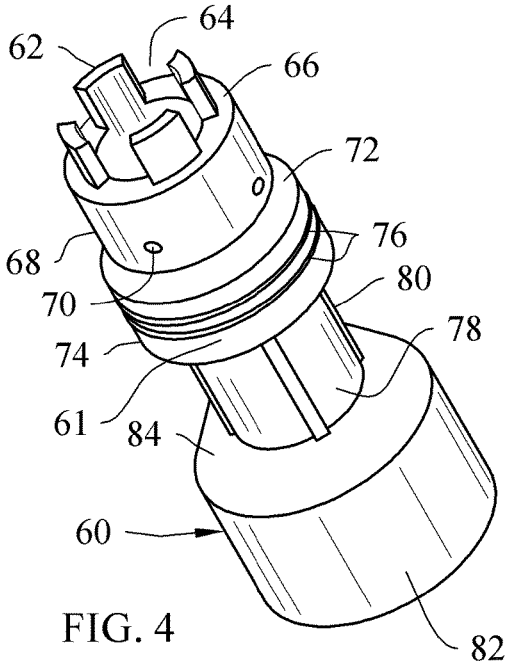
FIG. 4 is a perspective view of the activation unit of the present invention.

With reference to FIG. 4, the activation unit 60 can include an activation unit body 61 defining a hollow interior therethrough, a first end 68 and a second end 82. The first end 68 can be described as a ball engaging end portion including at least one finger or a plurality of radially arranged fingers 62 extending away from the first end 68 in a direction substantially parallel with a longitudinal axis of the activation unit 60. The fingers 62 are in a radially spaced apart relationship with each other so as to define a gap 64 therebetween, wherein each gap 64 is in fluid communication with the hollow interior of the activation unit 60. The radial arrangement of the fingers 62 produce a diameter which is less than the diameter of the opening of the ball seat 32. Each of the fingers 62 include a distal end surface that can have a configuration capable of being received through the opening of the ball seat 32 and contact the ball 30. The diameter of the fingers 62 is less than a diameter of the first end 68 thereby creating a flanged edge 66.

The first end 68 can further include a smooth exterior surface section and a plurality of pressure ports 70 defined therethrough, wherein the pressure ports 70 can be in fluid communication with the hollow interior of the activation unit body 61. The smooth exterior surface section of the first end 68 has a configuration capable of sealingly contact with the interior seal 42 when assembled.

The activation unit 60 can further include a sealing section 74 having a diameter greater than the diameter of the first end 68, thereby creating a flanged edge 72. The sealing section 74 includes at least one exterior seal 76 that can have a configuration capable of sealingly contact with a smooth interior surface section of the receiver body 48 when assembled.

Adjacent the sealing section 74 is a key section 78 having a diameter less than the diameter of the sealing section 74. The key section 78 includes at least one key 80 that extends a length of the key section 78 substantially parallel with the longitudinal axis of the activation unit 60. The key 80 features a shape that corresponds with the key notch 58 so that activation unit 60 can be slidably received with the second end 56 of the receiver unit 46. The key 80 and key notch 58 configuration provides guided reciprocal movement between that activation unit 60 and the receiver unit 46.

The second end 82 transitions from the key section 78 and has a diameter greater than the diameter of the key section 78 thereby creating an edge 84. The edge 84 can be a flanged or conical edge. The second end 82 includes internal or external threading having a configuration capable of engaging with corresponding threading of the drilling unit 6.

For assembly purposes, it can be appreciated that the receiver unit 46 can be separable sections that are coupled together about the activation unit 60 so that the key 80 is slidable received in the key notch 58. This arrangement allows for the activation unit 60 to be received by the receiver unit 46, and the receiver unit 46 can then be assembled with the annular lip 52 received in the annular notch 36.

Alternatively for assembly purposes, the second end 82 may be separable from the key section 78, and the diameter of the sealing section 74 can be less than a diameter of the annular lip 52. This alternative arrangement allows for the key section 78 of the activation unit 60 to be received in the receiver unit 46, and the second end 34 of the jetting unit 12 can then be received in the first end 50 of the receiver unit 46. The second end 82 of the activation unit 60 can then be secured to the key section 78.

Figure 5:
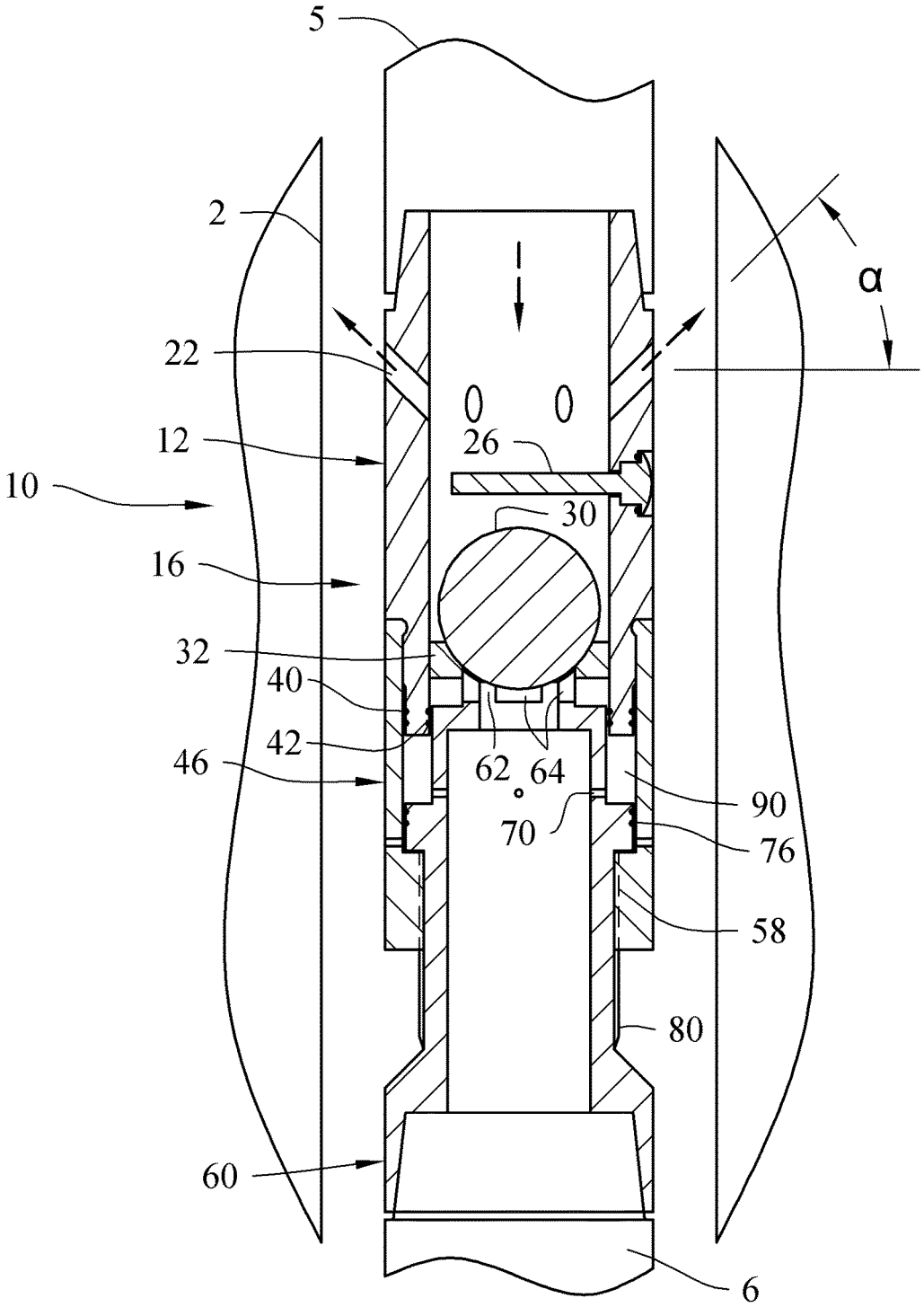
FIG. 5 is a cross-sectional view of the jetting assembly in a jetting operation.

In use, it can now be understood that the automatic downhole jetting system 10 is attached between the PDM 5 and the drilling unit 6 so as to create a BHA. This configuration is for exemplary purposes only since additional and/or different downhole tools can be connected to the automatic downhole jetting system 10 to create the BHA. The BHA can then be introduced into the wellbore 2. Working fluid is pumped down the coiled tubing 3 to provided pressurized working fluid to the jetting unit 12. As best illustrated in FIG. 5, the pressurized working fluid flows through the hollow interior of the jetting unit body 14, past the retaining pin 26 and forces the ball 30 against the ball seat 32. The ball 30 seals against the ball seat 32 which results in the working fluid to flow out the jet ports 22.

The jet ports 22 are angled rearwardly at an angle $\alpha$, thereby creating a rearward thrust force when the working fluid flows out the jet ports 22. This rearwardly directed thrust acts against the wall of the wellbore 2 thereby providing a motive force on the BHA and advancing the BHA through the wellbore 2. If desired, the coiled tubing 3 can be retracted thereby pulling the BHA back through the wellbore 2 and consequently creating a jet clean out operation. The angled flow from the jet ports 22 can force debris, such as but not limited to, bridge plugs, frac seats or portions thereof up through the wellbore 2 when the coiled tubing 3 and/or BHA is retracted.

In this jetting operation, the activation unit 60 is in an extended position because the working fluid pushes against the ball 30 which pushes against the fingers 62 of the activation unit 60. In this configuration, the sealing section 74 is retained by an interior ledge of the second end 56 of the receiver unit 46. A first annular space 90 is created between a distal end of the second end 34 of the jetting unit 12 and the flanged edge 72 of the sealing section 74. The pressure ports 70 provide fluid communication and pressure equalization between the first annular space 90 and the hollow interior of the activation unit 60.

Figure 6:
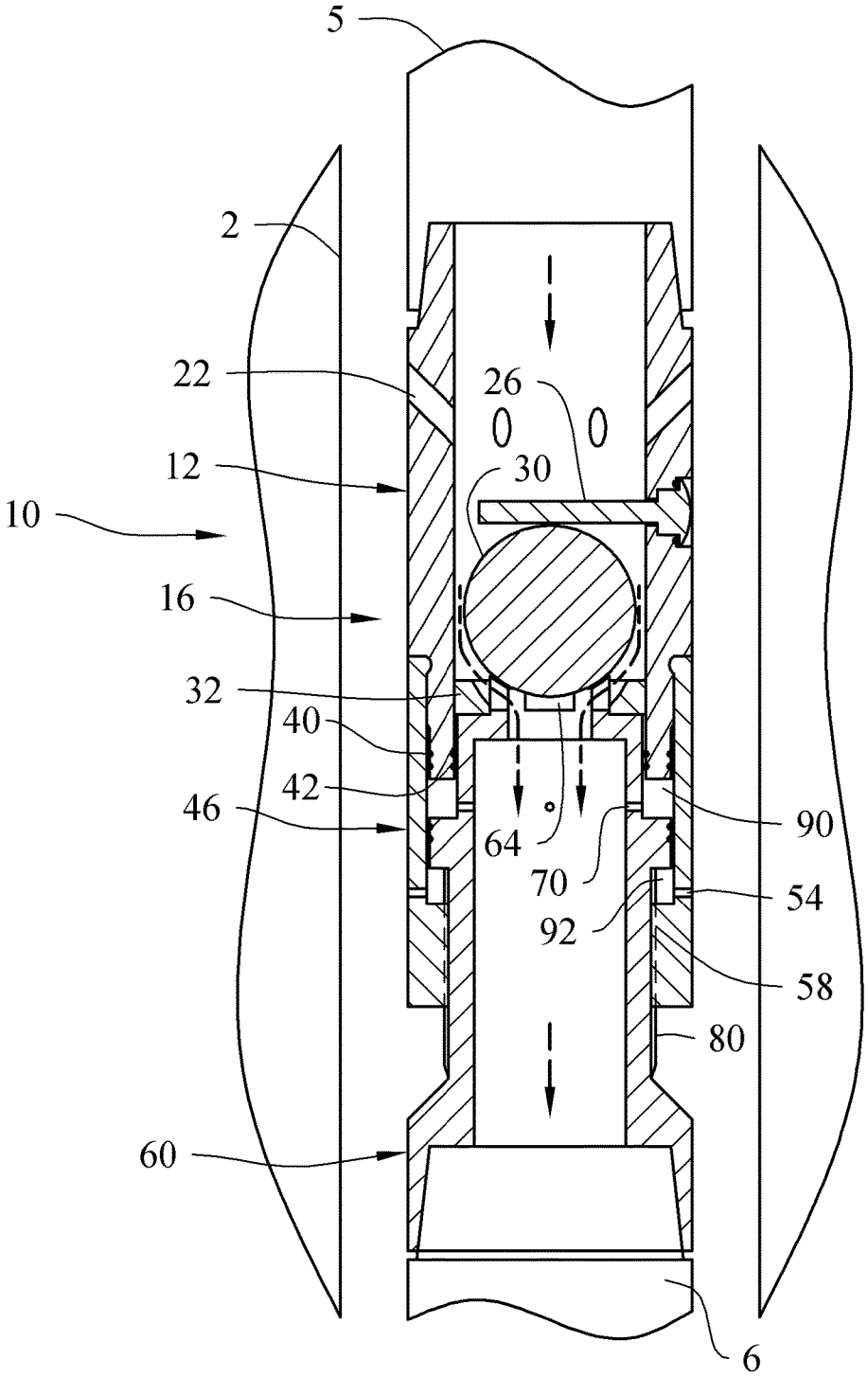
FIG. 6 is a cross-sectional view of the jetting assembly in a drilling operation.

Alternatively, as best illustrated in FIG. 6, while the BHA is advanced through the wellbore 2 by the working fluid exiting the jet ports 22, the BHA may encounter a restriction 8 in the wellbore 2. The restriction 8 can block forward travel of the BHA. During this situation, the restriction 8 will contact the drilling unit 6, which forces the activation unit 60 to slide toward the receiver unit 46 along the key 80 and key notch 58 arrangements. The sliding movement of the activation unit 60 moves the fingers 62 through the opening in the ball seat 32 and disengages the ball 30 from the ball seat 32.

When the ball 30 is disengaged from the ball seat 32, the working fluid is then allowed to pass around the ball 30, through the gaps 64 defined between the fingers 62, and through the opening in the ball seat 32. The working fluid can then flow toward the drilling unit 6, thereby operating the drilling unit 6 to remove the restriction 8.

In this configuration of the activation unit 60 moved toward the receiver unit 46, the moving of the activation unit 60 toward the receiver unit 46 reduces the size of the first annular space 90, and any fluid in the first annular portion 90 can be forced out through the pressure ports 70. Consequently, a second annular space 92 is created between the sealing section 74 and the interior ledge of the second end 56 of the receiver unit 46. The second annular space 92 is located on an opposite side of the sealing section 74 from that of the first annular space 90. The receiver ports 54 of the receiver unit 46 provide fluid communication and pressure equalization between the second annular space 92 and an annulus defined between the automatic downhole jetting system 10 and the wellbore 2.

The pressure balance created by the pressure ports 70 and the first annular space 90, and the receiver ports 54 and the second annular space 92, requires no atmospheric chamber. This reduces the force to dislodge the ball 30 from the ball seat 32 to that of the working fluid pressure acting on the surface area of the ball 30. This dislodging force can also be adjusted by using different sized balls, which would increase or decrease the working fluid pressure acting on the surface area of the ball 30.

It can be appreciated that the automatic downhole jetting system 10 is a multi-purpose downhole tool that provides a forward motive force to advance a BHA, a clean out operation of the wellbore 2, and an automatic valve operation actuated upon contact with a restriction 8 in the wellbore 2 to operate the drilling unit 6 to remove the restriction.

Fundamentally, the present invention takes the negative hydraulic force of pumped fluid that is trying to pump the string out of the wellbore and turning that hydraulic force into a positive force trying to hydraulically advance the string deeper into the wellbore.

While embodiments of the automatic downhole jetting system have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material may be used. And although advancing a downhole tool and automatically operating a drilling assembly have been described, it should be appreciated that the automatic downhole jetting system herein described is also suitable for providing any downhole valve operation automatically upon movement of one of its sections.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An automatic downhole jetting system comprising:

a jetting unit comprising a jetting unit body defining a hollow interior therethrough, at least one jet port defined through said jetting unit body and in fluid communication with said hollow interior, said hollow interior being capable of receiving a working fluid from a downhole tool or a downhole string;

a valve mechanism; and an activation unit slidably associated with said jetting unit, said activation unit comprising an activation unit body defining a hollow interior therethrough, an activation unit first end, and an activation unit second end, said activation unit first end having a configuration capable of activating said valve mechanism upon a sliding movement of said activation unit toward said jetting unit, said hollow interior of said activation unit body being in fluid communication with said hollow interior of said jetting unit body upon activation of said valve mechanism;

wherein said valve mechanism controls a flow of the working fluid into said hollow interior of said activation unit.

2. The automatic downhole jetting system of claim 1, wherein said jet port is angled from said hollow interior of said jetting unit body toward a jetting unit first end of said jetting unit, and wherein said jet port is configured to be in fluid communication with said hollow interior of said jetting unit body when said valve mechanism is activated.

3. The automatic downhole jetting system of claim 1, wherein said activation unit first end includes at least one finger having a configuration capable of activating said valve mechanism and allowing the working fluid to enter said hollow interior of said activation unit body upon the activation of said valve mechanism.

4. The automatic downhole jetting system of claim 3, wherein said valve mechanism includes a movable valve member having a configuration capable of being activated by said finger.

5. The automatic downhole jetting system of claim 4, wherein said finger is a plurality of fingers defining a gap between each of said fingers, said fingers having a configuration capable of being received through an opening defined in a part of said valve mechanism.

6. The automatic downhole jetting system of claim 1, wherein said valve mechanism is selected from the group consisting of a ball, a plug, a flapper, a diaphragm, and a piston.

7. The automatic downhole jetting system of claim 5, wherein said part of said valve mechanism is a valve seat with said opening defined therethrough.

8. The automatic downhole jetting system of claim 1 further comprising a receiver unit attachable to said jetting unit, said receiver unit comprising a receiver unit body defining a hollow interior therethrough, a receiver unit first end attachable to said jetting unit, and a receiver unit second end, wherein a portion of said hollow interior of said receiver unit body has a configuration capable of slidably receiving a portion of said activation unit.

9. The automatic downhole jetting system of claim 8, wherein said receiver unit first end includes an annular lip having a configuration capable of being received in an annular notch defined in said jetting unit body.

10. The automatic downhole jetting system of claim 8, wherein said jetting unit includes a jetting unit second end, and at least one seal associated with said jetting unit second end, said seal having a configuration capable of contacting with an interior surface of said receiver unit body.

11. The automatic downhole jetting system of claim 8, wherein said activation unit further comprises a key section including at least one key extending outwardly therefrom, said key has a configuration capable of being slidably received in a key notch defined in said receiver unit.

12. The automatic downhole jetting system of claim 11, wherein said activation unit further comprises a sealing section including at least one seal, said seal has a configuration capable of contacting with an interior surface of said receiver unit body.

13. The automatic downhole jetting system of claim 12, wherein said sealing section is located between said activation unit first end and said key.

14. The automatic downhole jetting system of claim 12, wherein said activation unit further comprises at least one pressure port defined through said activation unit body, said pressure port being in fluid communication with said hollow interior of said activation unit body and said hollow interior of said receiver unit body.

15. The automatic downhole jetting system of claim 14, wherein said pressure port is located between said seal of said sealing section and said activation unit first end.

16. The automatic downhole jetting system of claim 12, wherein said receiver unit further comprises at least one receiver port defined through said receiver unit body, said receiver port being in fluid communication with said hollow interior of said receiver unit body between said seal of said sealing section and said receiver unit second end.

17. The automatic downhole jetting system of claim 11, wherein said key and said key notch are parallel with a longitudinal axis of said activation unit body and said receiver unit body, respectively.

18. The automatic downhole jetting system of claim 1, wherein said jetting unit further comprises a valve retaining element extending into said hollow interior of said jetting unit body, said valve retaining element has a configuration capable of preventing movement of said valve mechanism out of said jetting unit.

19. The automatic downhole jetting system of claim 1, wherein said valve mechanism prevents the working fluid to flow into said hollow interior of said activation unit when said valve mechanism is not activated by said activation unit.

20. A method of using an automatic downhole jetting system, said method comprising the steps of:

a) receiving a working fluid to a jetting unit;

b) closing a valve mechanism by a flow of the working fluid, said valve mechanism having a configuration capable of preventing the working fluid to flow downstream therefrom;

c) flowing the working fluid through at least one jet port defined in said jetting unit;

d) moving an activation unit toward said jetting unit upon contacting a restriction in a wellbore, wherein an activation unit first end of said activation unit activates said valve mechanism upon a sliding movement of said activation unit toward said jetting unit;

e) opening a passage, upon said moving of said activation unit, between a hollow interior defined through said jetting unit and a hollow interior defined through said activation unit; and f) passing at least a portion of the working fluid through said valve mechanism into said hollow interior of said activation unit.

* * * * *